US007192513B2

(12) United States Patent
Al-Mahrous

(10) Patent No.: US 7,192,513 B2
(45) Date of Patent: Mar. 20, 2007

(54) CATHODIC PROTECTION JUNCTION BOX CURRENT EQUALIZER

(75) Inventor: Husain M. Al-Mahrous, Qatif-Al-Majidiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 10/252,869

(22) Filed: Sep. 23, 2002

(65) Prior Publication Data

US 2004/0057174 A1 Mar. 25, 2004

(51) Int. Cl.
*C02F 1/461* (2006.01)

(52) U.S. Cl. ..... 205/730; 205/744

(58) Field of Classification Search ..... 361/57, 361/93.7, 93.8, 93.9; 166/248; 204/196.02, 204/196.05, 196.06, 196.01, 196.36; 205/730, 205/744

See application file for complete search history.

(56) References Cited

U.S. PATENT DOCUMENTS

| | | | | | |
|---|---|---|---|---|---|
| 2,803,602 | A | * | 8/1957 | De Cowsky et al. | 204/196.26 |
| 3,143,670 | A | * | 8/1964 | Husock | 204/196.05 |
| 3,412,005 | A | * | 11/1968 | Beer et al. | 204/196.05 |
| 3,657,455 | A | * | 4/1972 | Trice | 315/308 |
| 4,138,323 | A | * | 2/1979 | Statsenko et al. | 204/196.02 |
| 4,437,957 | A | * | 3/1984 | Freeman | 205/727 |
| 4,526,667 | A | * | 7/1985 | Parkhurst et al. | 204/196.06 |
| 4,975,560 | A | * | 12/1990 | Wardy et al. | 204/196.05 |
| 5,040,599 | A | * | 8/1991 | Pfalser et al. | 166/248 |

* cited by examiner

*Primary Examiner*—Brian Sircus
*Assistant Examiner*—Danny Nguyen
(74) *Attorney, Agent, or Firm*—Abelman, Frayne & Schwab

(57) ABSTRACT

A cathodic protection junction box current equalizer has a plurality of output terminals each being connectable through a variable resistors to an anode, the resistors being controlled such that the corresponding anode outputs a desired current.

7 Claims, 2 Drawing Sheets

CATHODIC PROTECTION JUNCTION BOX CURRENT EQUALIZER

FIELD OF THE INVENTION

This invention relates to oil/gas field drilling, and more particularly to an improved method of supplying cathodic protection current to the anodic areas along an underground metal structure.

BACKGROUND OF THE INVENTION

Underground metal structures such as the underground casings of oil and gas wells and underground water tanks are subject to corrosion in localized areas due to electrical potential differences developed when the structure extends through different underground formations. The different formations generally each contain water having a different salt concentration, and therefore different potential differences are developed between the two sections of the structure in contact with the two formations. Electrons leave one of these sections, rendering this first area of this section anodic, flow through the structure and collect on the other of the sections, rendering this second area cathodic. The positive hydrogen ions then complete the circuit by gathering on the cathodic area through the formation.

As the electrons flow through the structure, an electrochemical process causes hydrogen atoms to form in the cathode area and iron from the casing to dissolve in the anode area. The iron is dissolved by the formation of iron ions. The hydrogen formed in the cathode area is removed by reaction with oxygen to form water or by the action of hydrogen consuming bacteria.

If the electron flow is permitted to continue, enough iron will be removed from the structure to corrode the structure and develop leaks.

Conventionally, this electrochemical corrosion in the anode area is prevented by connecting the negative terminal of a direct current source to the structure and connecting the positive terminal of the source to an anode buried in the earth adjacent to the well. If the direct current is appropriately applied, all points along the length of the structure will be cathodic with respect to the buried anode, the electrons will flow from the anode to the structure through the metallic path, and no corrosion of the structure occurs.

In accordance with conventional practice, soil resistivity measurements are conducted prior to the design of the anode bed to determine what is believed to be the best spot to install the anode bed. Where big differences in the soil resistivity are found, fixed value resistors have been installed in series with the individual anodes to control the respective anode discharge currents. However, this leads to unsafe conditions, especially in plant areas, due to the hazard associated with the heat generated from those resistors, which can be a source of ignition. The alternative is unbalanced individual anode currents.

Also, in accordance with conventional practice, water tank internal and external surfaces cannot be protected using a single rectifier, due to the difference in current requirements. The same problem applies to offshore metal structures protected with different types of anodes.

In coastal areas, cathodic protection systems protect the soil side of the structure as well as the submerged sections by connecting all the anodes to a common junction box. Multiple well casings connected to a common rectifier depend on the resistance of the negative cables to balance the current.

Accordingly, in view of the possibility of a large number of structures with differing potential requirements, the prior art has used an anode bed including a plurality of anodes of different sizes connected to a plurality of rectifiers for providing different amounts of cathodic protection current to these structures. This type of arrangement has proven to be expensive and cumbersome.

Moreover, this prior art arrangement can lead to errors in which incorrect amounts of current are drawn from the anodes.

FIG. 1 illustrates a conventional cathodic protection system including a junction box 10. An underground metal pipe 12 is provided at one position and an anode field 14, including a plurality of anodes 16, 18, is provided underground at another position.

A DC voltage source 20 is provided, having a positive terminal 22 and a negative terminal 24, with the junction box 10 positioned electrically between the positive terminal 22 of the voltage source 20 and the anode bed 16, 18. A respective cable 26, 28 extends from each anode 16, 18 to a corresponding terminal 36, 38 on the junction box 10, and a cable 30 extends from the positive terminal 22 of the voltage source 20 to a corresponding terminal 32 on the junction box 10. A cable 34 connects the negative terminal 24 of the voltage source 20 to the pipe 12.

One problem with this prior art structure is that the individual anode current outputs may be unbalanced depending on, for example, the different resistivities of the soil at different locations. This problem has been addressed in the prior art by either (a) disconnecting some of the anodes if they produce more current than specified by the manufacturer, or (b) having the high current output anodes consume first, with the remaining anodes sharing the additional load, thereby increasing the anode bed resistance and shortening the life of the anode bed.

SUMMARY OF THE INVENTION

It is therefore an object of the present invention to provide an arrangement for applying cathodic protection current to the anodic areas of an underground metal structure that avoids the above-described difficulties of the prior art.

It is a further object of the present invention to provide such an arrangement that requires a minimum number of rectifiers.

It is yet a further object of the present invention to provide a "smart" arrangement that can calculate the remaining life of each anode.

It is still a further object of the present invention to provide such an arrangement that accurately balances the anode currents.

The above and other objects are achieved by the present invention which, in one embodiment, is directed to a cathodic protection junction box current equalizer for providing cathodic protection current to a plurality of anodic areas on at least one metal structure, the equalizer being electrically positioned between a rectifier and an anode bed having a plurality of buried anodes. The equalizer comprises a main terminal connectable to receive a positive voltage from the rectifier, a plurality of output terminals, and a plurality of resistors each having a variable resistance value, each of the output terminals being connectable through a corresponding one of the resistors to a corresponding one of the anodes, and the resistance value of each of the resistors being controlled such that the corresponding anode outputs a desired current. The equalizer further comprises a heat dissipative structure for dissipating heat losses of the resistors.

In accordance with an advantageous feature, each of the resistors is electronically controlled.

In a preferred embodiment, the equalizer is operable in an EVEN mode wherein the resistance values of the resistors are electronically controlled to distribute current equally among all the anodes. The equalizer is also operable in a PRESET mode wherein a respective amount of current is specified by the operator for each anode and the resistance values of the resistors are controlled to achieve the specified amounts of current.

In accordance with a further development, the heat dissipative structure is an oil bath.

These and other objects, features and advantages of the present invention will be apparent from the following detailed description of the preferred embodiments taken in conjunction with the following drawings, wherein like reference numerals denote like elements.

DETAILED DESCRIPTION OF THE PREFERRED EMBODIMENTS

The cathodic protection junction box current equalizer in accordance with the present invention balances the anode outputs at the junction box so that, depending on the need, either all anodes will discharge the same amount of current or each anode will produce the desired current output.

Figure 1:
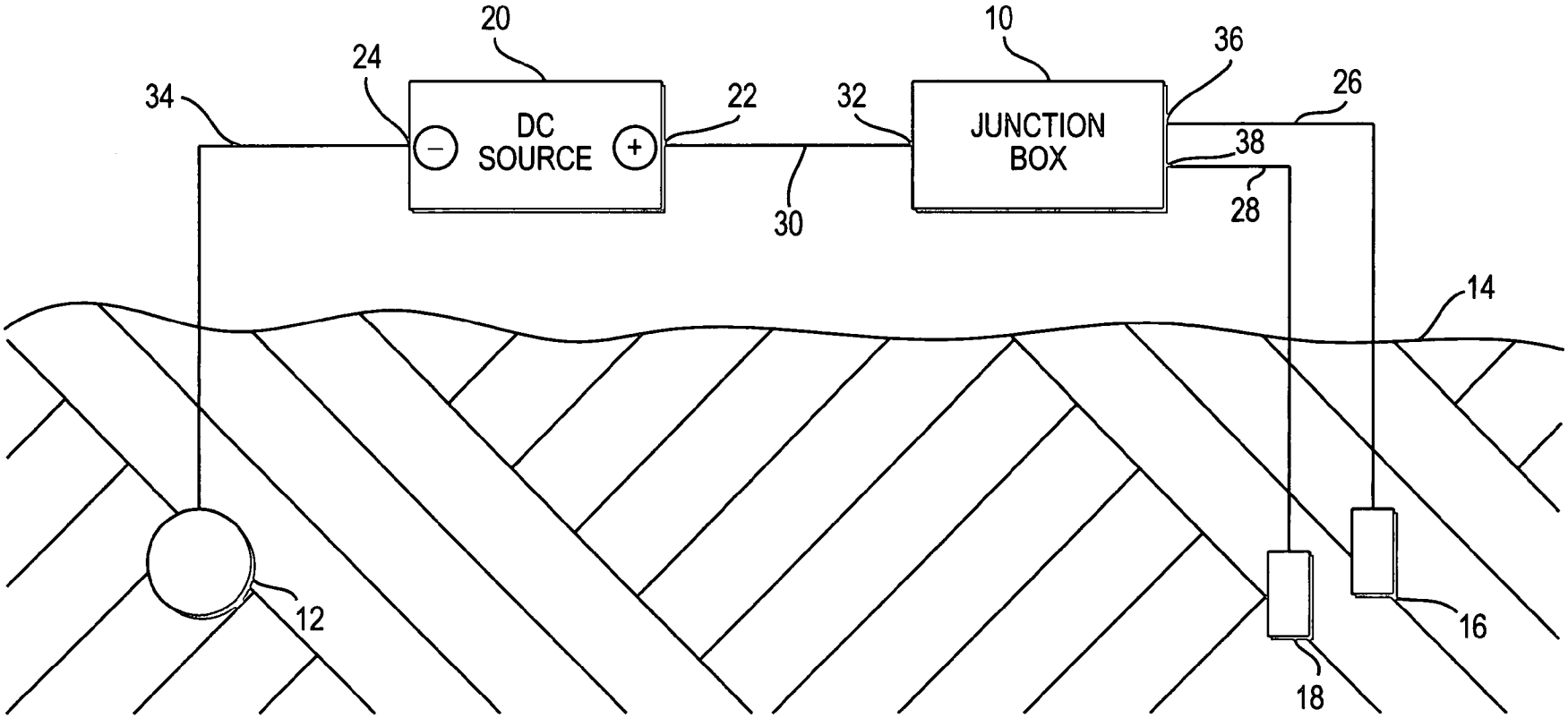
FIG. 1 PRIOR ART
FIG. 1 is a schematic illustration of a cathodic protection system in accordance with the prior art.
Figure 2:
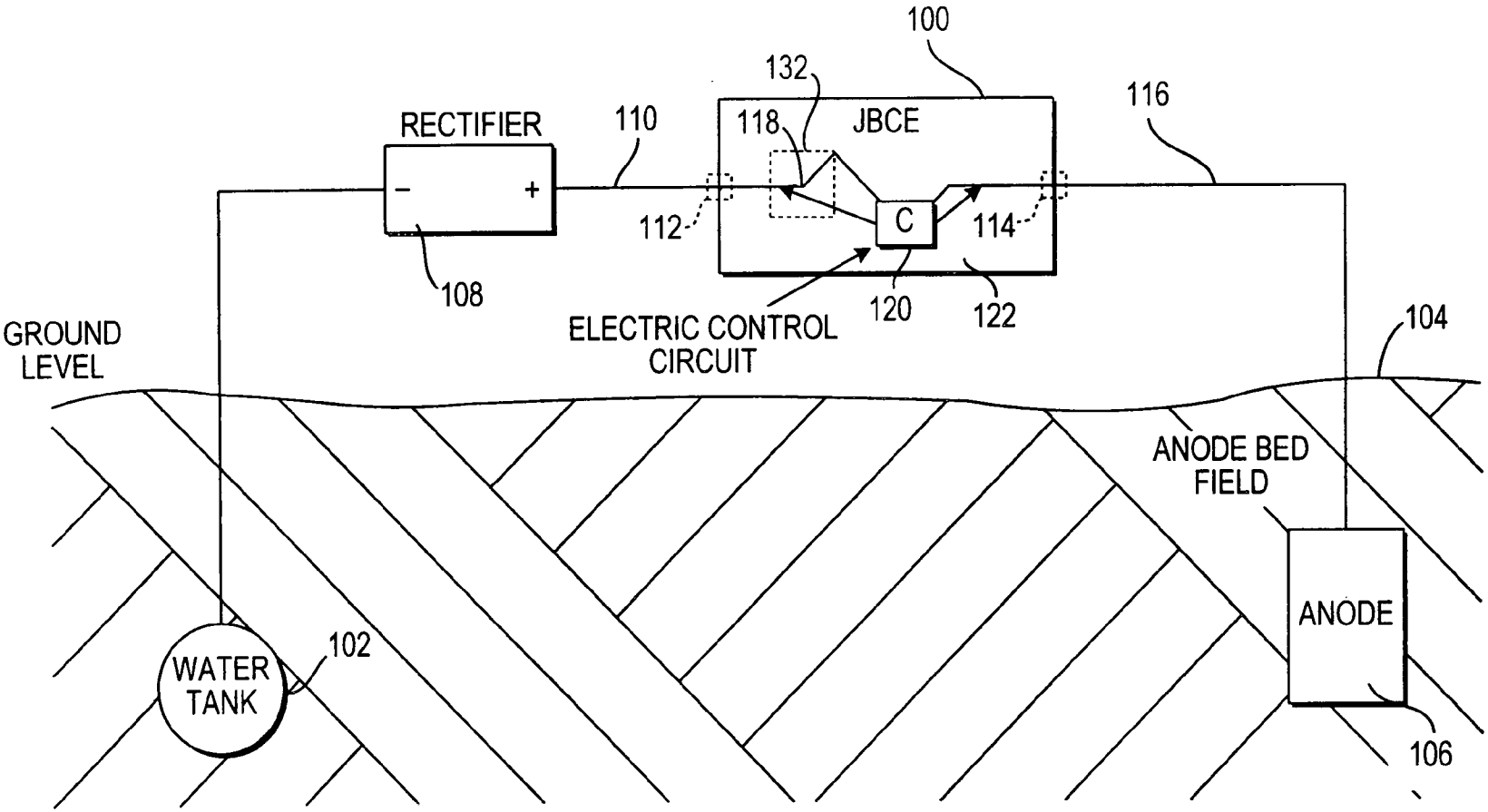
FIG. 2 is a schematic block diagram of a cathodic protection junction box current equalizer in accordance with the present invention.

As shown in FIG. 2, a cathodic protection system in accordance with the present invention includes a junction box 100 that functions as a current equalizer, hereinafter referred to as the JBCE 100. In the illustrated embodiment, the underground metal structure is a water tank 102 provided underground at one position, and an anode bed 104, including a plurality of anodes 106, is provided underground at another position.

A rectifier 108 is provided, operating as a DC voltage source, with the JBCE 100 being an intermediate device electrically between the rectifier 108 and the anode bed 104. The main positive feeder cable 110 coming from the rectifier 108 is connected to the main terminal 112 of the JBCE 100.

The JBCE 100 has a plurality of output terminals 114. In the illustrated embodiment, the number of output terminals 114 is twelve, but any other appropriate number may be provided, such as five or twenty. A respective anode lead wire 116 extends from each output terminal 114 to a respective one of the anodes 106. The JBCE 100 automatically couples each output terminal 114, and hence its corresponding anode 106, to the main terminal 112 through a respective resistor 118 using an electronic control circuit 120 to control and achieve the required current output from the anode 106 (or anode bed 104) connected to that output terminal 114.

Advantageously, the JBCE 100 has two modes of operation, the EVEN mode and the PRESET mode.

In the EVEN mode, the main current is evenly distributed among all the anodes 106. More specifically, for anodes of the same type, in the same anode bed and terminated at a common junction box, the JBCE 100 will uniformly distribute the current among all the anodes. This does not necessarily mean that the resistances are all the same, since each anode circuit faces its own particular circumstances. In this mode, all anodes will discharge the cathodic protection current evenly, and therefore will consume at the same rate and will have the same life span.

As an example where the EVEN mode is advantageously applicable is for remote anode beds protecting pipelines and well casings, where it is required to discharge the same amount of current from each anode.

As another example, the JBCE 100 in the EVEN mode will evenly discharge the current between two tanks protected by one cathodic protection rectifier system, even if one of them is sitting on a higher resistivity sand pad than the other.

On the other hand, the PRESET mode is especially advantageous for anodes installed in soils of varying resistivities, e.g. the distributed anodes along a pipeline run. The PRESET mode of the JBCE 100 controls the current from each anode to hold it to a specified "preset" value. That is, in the PRESET mode, the cathodic protection operator will specify the amount of current discharge required from each anode 106 based on, for example, either pipe-to-soil potential or past operational experience. The resistors 118 are automatically electronically controlled through the control circuit 120 to have the value required for providing the specified amount of current.

When multiple well casings, for example, are fed from a common rectifier, the JBCE 100 will balance the current depending on the need. If the well casings are the same service type (oil, gas, water etc.), the JBCE 100 in the EVEN mode will balance the negative current drain from all of them, without the need to install different size negative cables for current balancing. If the well casings are of varying service and require different drain current values, the JBCE 100 in the PRESET mode will ensure that each well casing only drains the required amount of current. In accordance with an advantageous aspect of the present invention, means are provided in order to dissipate the $I^2R$ heat generated. In the illustrated embodiment, the resistors 118 are advantageously embedded in an oil bath 132 but other means and methods may be used. Because the resistors 118 are variable and electronically controlled, they may be placed in a safe, heat dissipative environment and still have their resistance values varied as desired.

This JBCE 100 advantageously minimizes and controls the design error associated with conducting soil resistivity measurements, since it can balance the current of each anode regardless of the soil resistivity around that anode. That is, if there is an error in a soil resistivity measurement, or if the soil resistivity changes over time, the values of the resistances of the resistors 118 can be changed to meet any desired specifications.

The JBCE 100 also allows for the use of fewer rectifiers of higher output in plant areas, because the current output from each anode is independently controlled.

Both the internal and external sides of the cathodically protected metal structure can be protected with the same rectifier, with only one negative cable for draining the current back to the rectifier.

In coastal areas, cathodic protection systems for protecting the soil side of the metal structure using the JBCE 100 can also protect any submerged sections by connecting all the anodes in common to the JBCE 100.

Multiple metal structures, such as multiple well casings, can be protected with a single rectifier using the present invention without the need for sizing the resistance of the drain negative cables to balance the current.

The JBCE 100 eliminates the need for different anode sizes (e.g. TA-4 and TA-5A), where soil resistivity variations would dictate otherwise.

It is also possible to have improve the function of the disclosed junction box in order to make a "smart" junction box that can calculate the remaining life of each anode based on the individual anode current discharged and with the help of an hour meter, so as to account for the time the CP system has been in actual operation.

It will be understood by those of ordinary skill in the art that any number of anodes may be provided, of any suitable composition and at any suitable depths in dependence on the particular application. It will also be understood that the underground structure may be any structure to which the present invention may be advantageously applied, including structures that are entirely or only partially metallic.

While the disclosed apparatus has been particularly shown and described with respect to the preferred embodiments, it is understood by those skilled in the art that various modifications in form and detail may be made therein without departing from the scope and spirit of the invention. Accordingly, modifications such as those suggested above, but not limited thereto are to be considered within the scope of the invention, which is to be determined by reference to the appended claims.

I claim:

1. A cathodic protection junction box current equalizer for providing cathodic protection current to a plurality of anodic areas on at least one metal structure, where said anodic areas are associated with different underground formations, said equalizer being electrically positioned between a rectifier and an anode bed having a plurality of buried anodes and comprising:

a main terminal connectable to receive a positive voltage from the rectifier;

a plurality of output terminals;

a plurality of resistors each having a variable resistance value, each of said resistor being connectable thorough a corresponding each of said output terminals to a corresponding one of said anodes, each of said resistors being electrically connected, through said main terminal, in series connection with said rectifier, and said resistance value of each of said resistors being controlled such that the corresponding anode outputs a current adapted to provide cathodic protection at a corresponding anodic area;

control circuit means to control current output from each anode by controlling value of each resistor connected to said each anode; and a heat dissipative structure for dissipating heat losses of said resistors, wherein said control circuit means selectively changes equalizer's operation mode between EVEN mode where said values of said resistors are controlled to distribute current equally among all the anodes, and PRESET mode where a respective amount of current is specified for each anode and said resistance values of said resistors are controlled to achieve the specified amounts of current.

2. The equalizer of claim 1, wherein each of said resistors is electronically controlled.

3. The equalizer of claim 1, wherein said equalizer is operable in an EVEN mode wherein said resistance values of said resistors are controlled to distribute current equally among all the anodes.

4. The equalizer of claim 3, wherein said equalizer is operable in a PRESET mode wherein a respective amount of current is specified for each anode and said resistance values of said resistors are controlled to achieve the specified amounts of current.

5. The equalizer of claim 1, wherein said equalizer is operable in a PRESET mode wherein a respective amount of current is specified for each anode and said resistance values of said resistors are controlled to achieve the specified amounts of current.

6. The equalizer of claim 1, wherein said heat dissipative structure is an oil bath.

7. A cathodic protection junction box current equalizer for providing cathodic protection current to a plurality of anodic areas on at least one metal structure, said equalizer being electrically positioned between a rectifier and an anode bed having a plurality of buried anodes and comprising:

a main terminal connectable to receive a positive voltage from the rectifier;

a plurality of output terminals;

a plurality of resistors each having a variable resistance value, each of said resistor being connectable thorough a corresponding each of said output terminals to a corresponding one of said anodes, each of said resistors being electrically, through said main terminal, in series connection with said rectifier, and said resistance value of each of said resistors being controlled such that the corresponding anode outputs a desired current;

control circuit means to control current output from each anode by controlling value of each resistor connected to said each anode; and a heat dissipative structure for dissipating heat losses of said resistors, wherein said control circuit means selectively changes equalizer's operation mode between EVEN mode where said values of said resistors are controlled to distribute current equally among all the anodes, and PRESET mode where a respective amount of current is specified for each anode and said resistance values of said resistors are controlled to achieve the specified amounts of current.

* * * * *